US011759927B2

(12) United States Patent
Schulz

(10) Patent No.: US 11,759,927 B2
(45) Date of Patent: Sep. 19, 2023

(54) NON-MARRING PANEL REMOVER

(71) Applicant: Snap-on Incorporated, Kenosha, WI (US)

(72) Inventor: Ben T. Schulz, Oak Creek, WI (US)

(73) Assignee: Snap-on Incorporated, Kenosha, WI (US)

( * ) Notice: Subject to any disclaimer, the term of this patent is extended or adjusted under 35 U.S.C. 154(b) by 166 days.

(21) Appl. No.: 15/687,967

(22) Filed: Aug. 28, 2017

(65) Prior Publication Data

US 2019/0061125 A1 Feb. 28, 2019

(51) Int. Cl.

| | |
|---|---|
| ***B25B 27/00*** | (2006.01) |
| ***B66F 15/00*** | (2006.01) |
| ***B25B 27/14*** | (2006.01) |
| ***B25C 11/00*** | (2006.01) |

(52) U.S. Cl.

CPC ..... *B25B 27/0035* (2013.01); *B25B 27/14* (2013.01); *B25C 11/00* (2013.01); *B66F 15/00* (2013.01)

(58) Field of Classification Search

CPC ..... B25B 27/0035; B25B 27/14; B66F 15/00; B25C 11/00; B25D 1/045; B25D 1/10; B25D 2250/105; B25D 2250/111

USPC ..... 29/278

See application file for complete search history.

(56) References Cited

U.S. PATENT DOCUMENTS

| | | | | |
|---|---|---|---|---|
| 897,293 A | | 9/1908 | Korpi | |
| 949,337 A | | 2/1910 | Trogner | |
| 1,486,820 A | | 3/1924 | Wilder | |
| 3,125,143 A | * | 3/1964 | Wilson | B25D 1/04 81/21 |
| 3,134,574 A | | 5/1964 | Reuterfors | |
| 3,385,334 A | * | 5/1968 | Clay | B25D 1/00 81/19 |
| 4,688,761 A | | 8/1987 | Wilcox | |
| 4,844,416 A | | 7/1989 | Hand | |
| 5,255,575 A | * | 10/1993 | Williams | B25F 1/02 81/26 |
| 5,495,651 A | | 3/1996 | Tsuha | |
| 5,695,172 A | | 12/1997 | Hreha | |

(Continued)

FOREIGN PATENT DOCUMENTS

| | | |
|---|---|---|
| AU | 2018201601 A1 | 3/2019 |
| CA | 2998000 A1 | 2/2019 |

(Continued)

OTHER PUBLICATIONS

Australian Examination Report No. 1 for Application No. 2018201601 dated Feb. 26, 2019, 5 pages.

(Continued)

*Primary Examiner* — Seahee Hong
(74) *Attorney, Agent, or Firm* — Seyfarth Shaw LLP

(57) ABSTRACT

Disclosed is a panel removing tool having a bend portion that is located behind a fulcrum of the tool. During use, the tool pivots about the bend portion applies leverage to remove a panel. The bend portion includes a cover (for example a dipped polymer) that is made of a material softer than a material of the remainder of the tool (for example, stainless steel). The tool therefore prevents scratching or other damage to panels in which the tool is used and allows greater leverage during use due to the recessed bend portion.

17 Claims, 1 Drawing Sheet

(56) References Cited

U.S. PATENT DOCUMENTS

| | | | | |
|---|---|---|---|---|
| D444,690 | S | 7/2001 | Bond | |
| 6,257,553 | B1 * | 7/2001 | Khachatoorian | B66F 15/00 254/21 |
| 6,347,562 | B1 * | 2/2002 | Gerber, Jr. | B25D 1/02 81/25 |
| 6,663,082 | B1 | 12/2003 | Ploeger | |
| 6,752,380 | B1 | 6/2004 | Taylor et al. | |
| 6,948,700 | B2 * | 9/2005 | Wood | B66F 15/00 254/21 |
| 6,959,917 | B2 | 11/2005 | Hernandez et al. | |
| 6,994,322 | B1 * | 2/2006 | Wittman | A44B 15/005 254/131 |
| 7,367,098 | B2 | 5/2008 | Wang | |
| 7,503,545 | B2 | 3/2009 | Verbowski | |
| D594,720 | S | 6/2009 | Kliskey | |
| 7,618,031 | B2 | 11/2009 | Weaver et al. | |
| 7,735,806 | B2 | 6/2010 | Prater et al. | |
| 8,567,760 | B2 | 10/2013 | Sindt | |
| 2004/0129388 | A1 | 7/2004 | Brazil | |
| 2005/0062026 | A1 | 3/2005 | Holcomb | |
| 2008/0029223 | A1 | 2/2008 | Kliskey | |
| 2008/0191181 | A1 | 8/2008 | Verbowski | |
| 2009/0000427 | A1 * | 1/2009 | Lacina | B25B 33/00 81/15.9 |
| 2009/0230369 | A1 * | 9/2009 | Kurtz | B66F 15/00 254/131 |
| 2011/0000592 | A1 * | 1/2011 | Shenk | B25C 11/00 150/161 |
| 2011/0155979 | A1 * | 6/2011 | Sindt | B25C 11/00 254/131 |
| 2014/0259605 | A1 | 9/2014 | Dorsey | |
| 2018/0117752 | A1 * | 5/2018 | Weber | B25F 1/02 |
| 2018/0127250 | A1 * | 5/2018 | Bizyaev | B66F 15/00 |
| 2019/0061125 | A1 | 2/2019 | Schulz | |

FOREIGN PATENT DOCUMENTS

| | | | |
|---|---|---|---|
| CN | 1618574 | | 5/2005 |
| CN | 202029115 | U | 11/2011 |
| CN | 103517787 | | 1/2014 |
| CN | 203371444 | | 1/2014 |
| CN | 105947943 | A | 9/2016 |
| CN | 205556021 | U | 9/2016 |
| CN | 210282107 | U * | 4/2020 |
| DE | 202008016291 | U1 | 7/2009 |
| EP | 1946893 | | 8/2009 |
| GB | 2303572 | | 2/1997 |
| JP | 2003181539 | | 7/2003 |
| JP | 2009279743 | A | 12/2009 |
| TW | M310787 | U | 5/2007 |
| TW | 201544267 | | 12/2015 |
| TW | I592263 | | 7/2017 |
| WO | 2009068662 | A1 | 6/2009 |
| WO | 2009094697 | | 8/2009 |
| WO | 2018086499 | | 5/2018 |

OTHER PUBLICATIONS

UK Combined Search and Examination Report for Application No. GB 1803715.0 dated Aug. 31, 2018, 7 pages.

Canadian Office Action for Application No. 2,998,000, dated Mar. 29, 2019, 3 pages.

Taiwan Office Action Action for Application No. 107129754, dated Apr. 24, 2019, 6 pages.

Examination Report No. 2 for Australian Application No. 2018201601 dated Jan. 15, 2020, 6 pages.

Canadian Office Action for Application No. 2,998,000 dated Jan. 31, 2020, 3 pages.

Chinese Office Action for Application No. 201810556180 X dated Jan. 22, 2020, 8 pages.

Examination Report for Application No. GB1803715.0 dated Oct. 11, 2019, 3 pages.

Chinese Office Action for Application No. 201810556180.X dated Oct. 10, 2020, 5 pages.

Chinese Office Action for corresponding CN Application No. 201810556180.X dated Jul. 6, 2021, 5 pages.

Chinese Office Action for Application No. 201810556180.X dated Mar. 25, 2021, 8 pages.

Examination Report No. 1 for Australian Application No. 2020203595 dated Apr. 21, 2021, 4 pages.

* cited by examiner

NON-MARRING PANEL REMOVER

TECHNICAL FIELD OF THE INVENTION

The present invention relates generally to panel removers. More particularly, the present invention relates to a remover that can open or remove a panel without damaging neighboring components.

BACKGROUND OF THE INVENTION

Trims and panels are commonly found in modern day technology. For example, automobile panels are prevalent in motor vehicles and allow thin sheets of metal to provide an outer body of the automobile or an inner casing within the vehicle. These panels typically cover less visually-appealing mechanical components of the machine to avoid exposing the unsightly machinery.

Panels are often hinged or otherwise removable so as to allow access to the contents within the panel. A tool is often helpful in removing the panel and can even be required for panels with low clearance. Most of these tools are small, wire-shaped instruments that pry open the panel. However, these instruments often rub against the panel at a bend point of the instrument and destroy or scratch the surface on which they pivot.

Tools were therefore created to prevent marring of surfaces on which the instrument pivots. For example, FIG. 3 illustrates a prior art instrument 300 with a handle 305, a first portion 310 leading from the handle 305, and a second portion 315 extending from the first portion. A pry 320 is provided at the end of the instrument 300, and a sleeve 325 covers the pry 320. The sleeve 325 is helpful in preventing scratching at certain surfaces where a panel is lifted, but the pivot point of the instrument 300 is between the first 310 and second 315 portions, which include no such sleeve. Further, the pivot point at the first 310 and second 315 portions is not offset behind the fulcrum of the instrument 300 and therefore lacks appropriate leverage for lifting certain panels.

Other advancements include nylon or other soft material instruments. Such instruments are less likely to damage surfaces due to the soft material, but are also weak and bend easily, lacking the rigidity and strength for higher load applications.

SUMMARY OF THE INVENTION

The present invention broadly comprises a panel removing tool with a bend portion that is set behind the fulcrum of the tool for added leverage. The bend portion can include a cover, for example a dipped polymer, that is made of a material softer than the remainder of the tool so as to prevent scratching or other damage to panels in which the tool is used.

In particular, the present invention broadly comprises a removal tool including a handle, a base extending from the handle and having a longitudinal axis, a bend extending from the base and being offset from the longitudinal axis of the base, and a pry extending form the bend and adapted to be disposed underneath an object to be lifted. A cover can be provided that covers a fulcrum of the bend and is composed of a cover material softer than a bend material of the bend.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
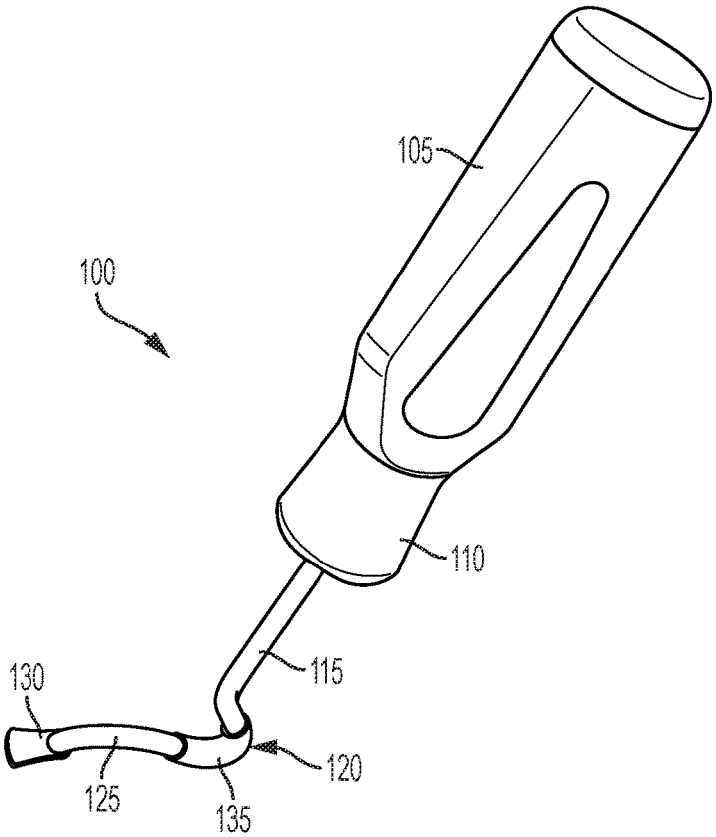
FIG. 1 is a front perspective view of a panel removing tool according to at least some embodiments of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a panel removing tool with added leverage due to a bend portion that is located behind a fulcrum of the tool. The tool can pivot about the bend portion when applying leverage to remove a panel, and the bend portion can include a cover, for example a dipped polymer, that is made of a material softer than the remainder of the tool. The tool therefore prevents scratching or other damage to panels in which the tool is used.

Figure 2:
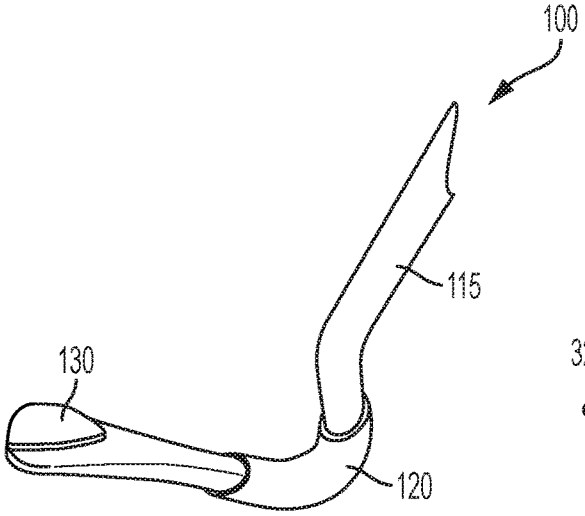
FIG. 2 is a partial exploded view of a panel removing tool according to at least some embodiments of the presently disclosed embodiments.
Figure 3:
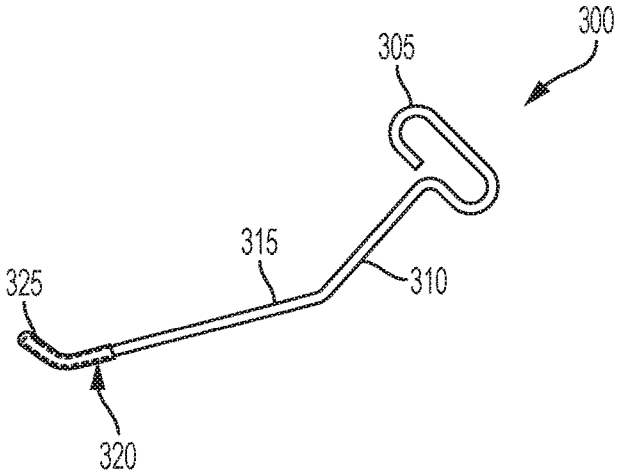
FIG. 3 PRIOR ART
FIG. 3 is a prior art tool.

As shown in FIGS. 1-2, a tool 100 can include a handle 105 with a neck 110 extending from the handle 105. A base 115 can extend from the neck 110, for example, by being inserted into a central portion of the neck 110 and being coupled inside the neck 110 and/or handle 105. A bend 120 can extend from the base 115 and lead to an extension 125 that then leads to a pry 130. The bend 120 can include a cover 135 made of a softer material as compared to the base 115 and/or pry 130, for example, vinyl or another polymer.

The handle 105 can be any structure capable of being gripped by a user. The handle 105 can include a texture or a separate structure that overlays the handle 105 to improve the grip of the user. The handle 105 can taper off at its end to form the neck 110. As discussed above, the neck 110 can include an opening that the base 115 inserts into to couple the base 115, bend 120, extension 125, and pry 130 to the handle 105. For example, the neck 110 can include internal threads, and the base 115 can include external threads, and the base 115 can threadably couple into the neck 110. The base 115 can also be coupled into the handle by an adhesive, a fastener, or a simple friction fit. Any other manner of coupling the base 115 and remaining components to the handle 105 can be implemented without departing from the spirit and scope of the present invention.

The base 115 acts as the structural backbone of the components of the tool 100 located outside of the handle 105. The base 115 connects the handle 105 to the bend 120, for example. The base 115 can be any shape but in some embodiments is a circular cross-section component that extends in a straight line from the neck 110 of the handle 105. As shown in FIG. 1, the base 115, bend 120, and extension 125 can also have respective base, bend, and extension cross-sections that have a substantially similar size and a substantially similar shape. The handle 105, which is capable of being gripped by a user, can have a handle cross-section that is larger than sizes of the base, bend, and extension cross-sections.

The bend 120 is the component of the tool 100 that a user pivots the tool 100 about to apply leverage and open a panel or other object. As shown, the bend 120 can have an offset fulcrum to allow for greater clearance and leverage. For example, the pry 130 can be located a first direction away from the longitudinal axis of the base 115, and the fulcrum of the bend 120 can be located a second direction away from the longitudinal axis of the base 115, where the first direction is opposite of the second direction. As shown, the bend 120 can be a 90° bend where the base 115 and pry 130 are angled at 90° with respect to each other. However, any angle can be implemented without departing from the spirit and scope of the present invention.

The pry 130 can be any shape that allows for an object to be lifted. For example, the pry 130 can be shaped as a flat blade, similar to a flat-head screwdriver, as best shown in FIG. 2. The pry 130 can also be a needle point, a fork, a scoop, a custom-shaped component, or any other shape.

The cover 135 is located at the bend 120 to help prevent marring of a surface when the tool 100 is in use. For example, the cover 135 can be a dipped polymer, e.g., vinyl, or can be any other polymer or soft material that would help prevent marring of surfaces about which the bend 120 is placed upon.

To use the tool 100, a user can first insert the pry 130 underneath a panel or surface to be lifted. The tool 100 can then be lowered so that the fulcrum of the bend 120 touches a surface. The tool 100 can then pivot about the fulcrum at the bend 120 and lift the panel or other object. Because the fulcrum of the bend 120 is offset from the base 115, the tool 100 can provide additional leverage as compared to prior art tools. Further, because the cover 135 is located at the fulcrum of the bend 120, the surface upon which the tool 100 is initially placed can be maintained and scratches can be avoided.

As discussed above, the cover 135 can be made of a softer material as compared to the material of the base 115, bend 120, extension 125, and/or the pry 130. For example, the base 115, bend 120, extension 125 and pry 130 can be made of a metallic material, e.g., stainless steel, and the cover 135 can be made of dipped vinyl or another polymer. However, the present invention is not so limited.

As shown in FIG. 1, the tool 100 can include an extension 125 extending from the cover 135 to the pry 130. However, the tool 100 need not include an extension 125 and can instead include a pry 130 extending directly from the cover 135, as shown in FIG. 2.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A removal tool comprising:

a handle having a handle cross-section;

a base extending from the handle and having a base longitudinal axis and a base cross- section;

a bend extending from the base and having a fulcrum that is offset relative to the base longitudinal axis, wherein the bend has a bend cross-section and a bend exterior surface;

a cover composed of a cover material that substantially surrounds the bend exterior surface forming a covered bend portion; and a pry extending from the covered bend portion and adapted to be disposed under an object to be lifted, wherein the fulcrum is located at a first position that is a first direction away from the base longitudinal axis, the pry is located at a second position that is a second direction away from the base longitudinal axis, and the first direction is opposite the second direction, and wherein the base and bend cross-sections have a substantially similar size and a substantially similar shape, and wherein the handle cross-section is larger than sizes of the base and bend cross-sections.

2. The removal tool of claim 1, wherein the pry is a flat blade.

3. The removal tool of claim 1, wherein the pry is a needle point.

4. The removal tool of claim 1, further comprising a neck extending from the handle and receiving the base.

5. The removal tool of claim 4, wherein the neck includes internal threads, the base includes corresponding external threads, and the base and the neck are threadably coupled together.

6. The removal tool of claim 1, further comprising an extension extending from the covered bend portion to the pry.

7. The removal tool of claim 6, wherein the pry and the extension are disposed at a 90° angle with respect to the base.

8. The removal tool of claim 6, wherein the extension is curved in a direction away from the base.

9. The removal tool of claim 1, wherein the cover includes a dipped polymer material.

10. The removal tool of claim 1, wherein the handle includes a gripping textured portion.

11. A panel removing tool for removing automotive panels, the tool comprising:

a handle having a handle cross-section;

a base extending from the handle and having a base longitudinal axis and a base cross- section;

a bend extending from the base and having a fulcrum that is offset relative to the base longitudinal axis, wherein the bend has a bend cross-section;

a cover composed of a cover material that substantially surrounds an exterior surface of the bend forming a covered bend portion; and a pry extending from the covered bend portion and adapted to be disposed under an object to be lifted, wherein the fulcrum is located at a first position that is a first direction away from the base longitudinal axis, the pry is located at a second position that is a second direction away from the base longitudinal axis, and the first direction is opposite the second direction.

12. The removal tool of claim 11, wherein the pry is a flat blade.

13. The removal tool of claim 11, wherein the pry is a needle point.

14. The removal tool of claim 11, further comprising an extension extending from the covered bend portion to the pry.

15. The removal tool of claim 14, wherein the extension is curved in a direction away from the base.

16. The removal tool of claim 11, wherein the cover includes a dipped polymer material, and the dipped polymer material is a softer material than a material of the bend.

17. The removal tool of claim 11, wherein the handle includes a textured gripping portion.

* * * * *